US009012118B2

(12) United States Patent
Chen et al.

(10) Patent No.: US 9,012,118 B2
(45) Date of Patent: Apr. 21, 2015

(54) TONER COMPOSITIONS AND PROCESSES

(75) Inventors: Allan K. Chen, Oakville (CA); Tie Hwee Ng, Mississauga (CA); Edward Graham Zwartz, Mississauga (CA); Michael S. Hawkins, Cambridge (CA)

(73) Assignee: Xerox Corporation, Norwalk, CT (US)

( * ) Notice: Subject to any disclaimer, the term of this patent is extended or adjusted under 35 U.S.C. 154(b) by 646 days.

(21) Appl. No.: 12/717,332

(22) Filed: Mar. 4, 2010

(65) Prior Publication Data

US 2011/0217647 A1 Sep. 8, 2011

(51) Int. Cl.
*G03G 9/00* (2006.01)
*G03G 9/087* (2006.01)

(52) U.S. Cl.
CPC ..... *G03G 9/08755* (2013.01); *G03G 9/08782* (2013.01); *G03G 9/08795* (2013.01); *G03G 9/08797* (2013.01)

(58) Field of Classification Search
USPC ..... 430/110.2, 108.8, 109.1, 110.1
See application file for complete search history.

(56) References Cited

U.S. PATENT DOCUMENTS 3,590,000 A 6/1971 Palermiti et al.
3,800,588 A 4/1974 Larson et al.
3,847,604 A 11/1974 Hagenbach et al.
4,295,990 A 10/1981 Verbeek et al.
4,298,672 A 11/1981 Lu
4,338,390 A 7/1982 Lu
4,935,326 A 6/1990 Creatura et al.
4,937,166 A 6/1990 Creatura et al.
5,236,629 A 8/1993 Mahabadi et al.
5,278,020 A 1/1994 Grushkin et al.
5,290,654 A 3/1994 Sacripante et al.
5,302,486 A 4/1994 Patel et al.
5,308,734 A 5/1994 Sacripante et al.
5,330,874 A 7/1994 Mahabadi et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,582,950 A 12/1996 Katagiri et al.
5,585,215 A 12/1996 Ong et al.
5,650,255 A 7/1997 Ng et al.
5,650,256 A 7/1997 Veregin et al.
5,723,253 A 3/1998 Higashino et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,863,698 A 1/1999 Patel et al.
5,869,215 A 2/1999 Ong et al.
5,902,710 A 5/1999 Ong et al.
5,910,387 A 6/1999 Mychajlowskij et al.
5,916,725 A 6/1999 Patel et al.
5,919,595 A 7/1999 Mychajlowskij et al.
5,925,488 A 7/1999 Patel et al.
5,977,210 A 11/1999 Patel et al.
6,063,827 A 5/2000 Sacripante et al.
6,214,507 B1 4/2001 Sokol et al.
6,593,049 B1 7/2003 Veregin et al.
6,704,538 B2 3/2004 Nakamura et al.
6,730,450 B1 5/2004 Moffat et al.
6,743,559 B2 6/2004 Combes et al.
6,756,176 B2 6/2004 Stegamat et al.
6,780,500 B2 8/2004 Dumouchel
6,830,860 B2 12/2004 Sacripante et al.
7,029,817 B2 4/2006 Robinson et al.
7,141,761 B1 11/2006 Dirubio et al.
7,316,879 B2 1/2008 Nakamura et al.
7,410,739 B2 8/2008 Nakamura et al.
2006/0222991 A1 10/2006 Sacripante et al.
2008/0070142 A1 3/2008 Furuki et al.
2009/0286176 A1* 11/2009 Ohmura et al. ..... 430/107.1
2009/0305159 A1* 12/2009 Zhou et al. ..... 430/110.2
2010/0310983 A1* 12/2010 Ou et al. ..... 430/137.14

* cited by examiner

*Primary Examiner* — Thorl Chea
(74) *Attorney, Agent, or Firm* — MDIP LLC

(57) ABSTRACT

Toners are provided which possess excellent blocking characteristics. The toners include cores including amorphous resins having low glass transition temperatures, amorphous resins having high glass transition temperatures, and crystalline resins, and shells including amorphous resins having high glass transition temperatures.

20 Claims, No Drawings

TONER COMPOSITIONS AND PROCESSES

BACKGROUND

This disclosure is generally directed to toner processes, and more specifically, emulsion aggregation and coalescence processes, as well as toner compositions formed by such processes and development processes using such toners for use with electrophotographic copying or printing apparatus.

Emulsion aggregation/coalescing processes for the preparation of toners are illustrated in a number of patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488 and 5,977,210. Other patents disclosing exemplary emulsion aggregation/coalescing processes include, for example, U.S. Pat. Nos. 6,730,450, 6,743,559, 6,756,176, 6,780,500, 6,830,860, and 7,029,817. The disclosures of each of the foregoing patents and publications are hereby incorporated by reference in their entirety.

Improved toners and methods for their production remain desirable.

SUMMARY

The present disclosure provides toners and processes for producing same. In embodiments, a toner of the present disclosure may include particles including a core including from about 8% to about 15% by weight of at least one amorphous resin having a glass transition temperature of from about 58.5° C. to about 66° C., in combination with from about 36% to about 43% by weight of at least one amorphous resin having a glass transition temperature of from about 53° C. to about 58° C., at least one crystalline resin, an optional wax and an optional colorant; and a shell including from about 25% to about 35% by weight of at least one amorphous resin having a glass transition temperature of from about 58.5° C. to about 66° C.

In other embodiments, a toner of the present disclosure may include particles including a core including from about 8% to about 15% by weight of at least one amorphous resin having a glass transition temperature of from about 58.5° C. to about 66° C., in combination with from about 36% to about 43% by weight of at least one amorphous resin having a glass transition temperature of from about 53° C. to about 58° C., at least one crystalline resin, at least one wax such as polyethylene, polypropylene, and polybutene, and combinations thereof, and an optional colorant; and a shell including from about 25% to about 35% by weight of at least one amorphous resin having a glass transition temperature of from about 58.5° C. to about 66° C.

In other embodiments, a toner of the present disclosure may include a core including from about 8% to about 15% by weight of at least one amorphous polyester resin having a glass transition temperature of from about 58.5° C. to about 66° C., in combination with from about 36% to about 43% by weight of at least one amorphous resin having a glass transition temperature of from about 53° C. to about 58° C., at least one crystalline polyester resin, at least one wax such as polyethylene, polypropylene, and polybutene, and combinations thereof, and an optional colorant; and a shell including from about 25% to about 35% by weight of at least one amorphous polyester resin having a glass transition temperature of from about 58.5° C. to about 66° C. In embodiments, the amorphous resin having a glass transition temperature of from about 58.5° C. to about 66° C., the amorphous resin having a glass transition temperature of from about 53° C. to about 58° C., or both, include an amorphous polyester resin of the formula:

(I)

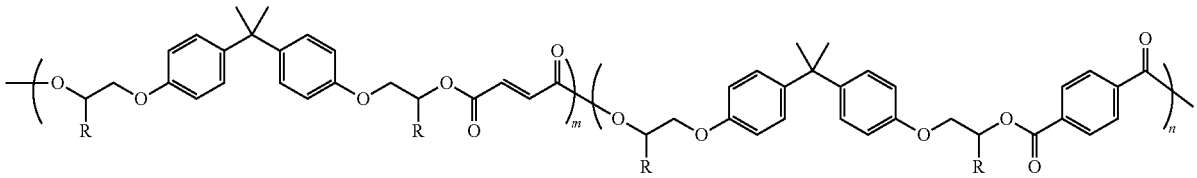

wherein R is a hydrogen or a methyl group, and m and n represent random units of the copolymer and m is from about 2 to about 10, and n is from about 2 to about 10, and wherein the at least one crystalline resin includes a crystalline polyester resin of the formula:

(II)

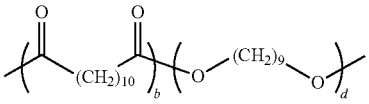

wherein b is from about 5 to about 2000 and d is from about 5 to about 2000.

DETAILED DESCRIPTION

In accordance with the present disclosure, low melt EA toners are provided which include a low molecular weight resin, optionally a high molecular weight resin, a crystalline resin, a pigment, and a wax. The toners of the present disclosure possess good fixing properties. In embodiments, the toners of the present disclosure possess a core-shell configuration, with a mixture of two amorphous resins in the shell. In embodiments, the two amorphous resins in the shell may include one possessing a high glass transition temperature (Tg), in combination with one possessing a low glass transition temperature (Tg).

Resin

Toners of the present disclosure may include any latex resin suitable for use in forming a toner. Such resins, in turn, may be made of any suitable monomer. Suitable monomers useful in forming the resin include, but are not limited to, acrylonitriles, diols, diacids, diamines, diesters, diisocyanates, combinations thereof, and the like. Any monomer employed may be selected depending upon the particular polymer to be utilized.

Any toner resin may be utilized in the processes of the present disclosure. Such resins, in turn, may be made of any suitable monomer or monomers via any suitable polymerization method. In embodiments, the resin may be prepared by a method other than emulsion polymerization. In further embodiments, the resin may be prepared by condensation polymerization.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, a resin utilized in forming a toner may include an amorphous polyester resin. In embodiments, the resin may be a polyester resin formed by reacting a diol with a diacid or diester in the presence of an optional catalyst.

Examples of organic diols selected for the preparation of amorphous resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfa-aliphatic diol can be selected in an amount of from about 1 to about 10 mole percent of the resin.

Examples of suitable polycondensation catalyst for either the amorphous polyester resin include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylenepropylene copolymers, ethylene-vinyl acetate copolymers, polypropylene, combinations thereof, and the like. Examples of amorphous resins which may be utilized include amorphous polyester resins. Exemplary amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a terpoly (propoxylated bisphenol A co-fumarate)-terpoly (propoxylated bisphenol A co-terephthalate)-terpoly-(propoxylated bisphenol A co-dodecylsuccinate), and combinations thereof. In embodiments, the amorphous resin utilized in the core may be linear.

In embodiments, a suitable amorphous polyester resin may be a copoly(propoxylated bisphenol A co-fumarate)-copoly (propoxylated bisphenol A co-terephthalate) resin having the following formula (I):

(I)

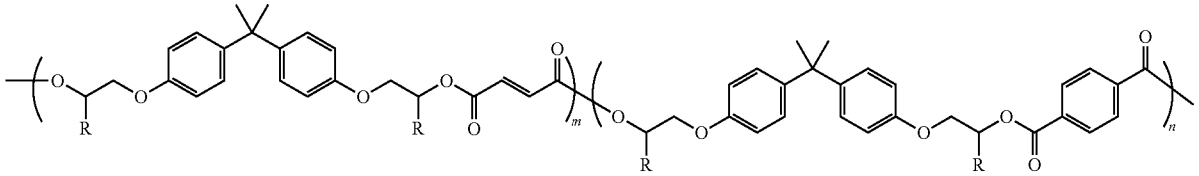

Examples of diacid or diesters selected for the preparation of the amorphous polyester include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, dimethyl dodecenylsuccinate, and mixtures thereof. The organic diacid or diester is selected, for example, from about 45 to about 52 mole percent of the resin.

wherein R may be hydrogen or a methyl group, and m and n represent random units of the copolymer and m may be from about 2 to 10, and n may be from about 2 to 10.

An example of a linear copoly(propoxylated bisphenol A co-fumarate)-copoly(propoxylated bisphenol A co-terephthalate) which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, North Carolina and the like.

In embodiments, the amorphous polyester resin may be a saturated or unsaturated amorphous polyester resin. Illustrative examples of saturated and unsaturated amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexylene-terephthalate, polyheptadene-terephthalate, polyoctalene-terephthalate, polyethylene-isophthalate, polypropylene-isophthalate, polybutylene-isophthalate, polypentylene-isophthalate, polyhexylene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexylene-adipate, polyheptadene-adipate, polyoctalene-adipate, polyethylene-glutarate, polypropylene-glutarate, polybutylene-glutarate, polypentylene-glutarate, polyhexylene-glutarate, polyheptadene-glutarate, polyoctalene-glutarate polyethylene-pimelate, polypropylene-pimelate, polybutylene-pimelate, polypentylene-pimelate, polyhexylene-pimelate, polyheptadene-pimelate, poly(ethoxylated bisphenol A-fumarate), poly(ethoxylated bisphenol A-succinate), poly(ethoxylated bisphenol A-adipate), poly(ethoxylated bisphenol A-glutarate), poly (ethoxylated bisphenol A-terephthalate), poly(ethoxylated bisphenol A-isophthalate), poly(ethoxylated bisphenol A-dodecenylsuccinate), poly(propoxylated bisphenol A-fumarate), poly(propoxylated bisphenol A-succinate), poly (propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), HETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof. The resins can also be functionalized, such as carboxylated, sulfonated, or the like, and particularly such as sodio sulfonated, if desired.

The amorphous polyester resin may be a branched resin. As used herein, the terms "branched" or "branching" includes branched resin and/or cross-linked resins. Branching agents for use in forming these branched resins include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Linear or branched unsaturated polyesters selected for reactions include both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions. Typical unsaturated polyester resins may be prepared by melt polycondensation or other polymerization processes using diacids and/or anhydrides and diols.

In embodiments, a suitable amorphous resin utilized in a toner of the present disclosure may be a low molecular weight amorphous resin, sometimes referred to, in embodiments, as an oligomer, having a weight average molecular weight (Mw) of from about 500 daltons to about 10,000 daltons, in embodiments from about 1000 daltons to about 5000 daltons, in other embodiments from about 1500 daltons to about 4000 daltons.

The low molecular weight amorphous resin may possess a glass transition temperature of from about 58.5° C. to about 66° C., in embodiments from about 60° C. to about 62° C.

The low molecular weight amorphous resin may possess a softening point of from about 105° C. to about 118° C., in embodiments from about 107° C. to about 109° C.

In further embodiments, the combined amorphous resins may have a melt viscosity of from about 10 to about 1,000,000 Pa*S at about 130° C., in embodiments from about 50 to about 100,000 Pa*S.

The monomers used in making the selected amorphous polyester resin are not limited, and the monomers utilized may include any one or more of, for example, ethylene, propylene, and the like. Known chain transfer agents, for example dodecanethiol or carbon tetrabromide, can be utilized to control the molecular weight properties of the polyester. Any suitable method for forming the amorphous or crystalline polyester from the monomers may be used without restriction.

In other embodiments, an amorphous resin utilized in forming a toner of the present disclosure may be a high molecular weight amorphous resin. As used herein, the high molecular weight amorphous polyester resin may have, for example, a number average molecular weight ($M_n$), as measured by gel permeation chromatography (GPC) of, for example, from about 1,000 to about 10,000, in embodiments from about 2,000 to about 9,000, in embodiments from about 3,000 to about 8,000, and in embodiments from about 6,000 to about 7,000. The weight average molecular weight ($M_w$) of the resin is greater than 45,000, for example, from about 45,000 to about 150,000, in embodiments from about 50,000 to about 100,000, in embodiments from about 63,000 to about 94,000, and in embodiments from about 68,000 to about 85,000, as determined by GPC using polystyrene standard. The polydispersity index (PD) is above about 4, such as, for example, greater than about 4, in embodiments from about 4 to about 20, in embodiments from about 5 to about 10, and in embodiments from about 6 to about 8, as measured by GPC versus standard polystyrene reference resins. The PD index is the ratio of the weight-average molecular weight ($M_w$) and the number-average molecular weight ($M_n$). The low molecular weight amorphous polyester resins may have an acid value of from about 8 to about 20 mg KOH/g, in embodiments from about 9 to about 16 mg KOH/g, and in embodiments from about 11 to about 15 mg KOH/g. The high molecular weight amorphous polyester resins, which are available from a number of sources, can possess various melting points of, for example, from about 30° C. to about 140° C., in embodiments from about 75° C. to about 130° C., in embodiments from about 100° C. to about 125° C., and in embodiments from about 115° C. to about 124° C.

High molecular weight amorphous resins may possess a glass transition temperature of from about 53° C. to about 58° C., in embodiments from about 54.5° C. to about 57° C.

The amorphous resin is generally present in the toner composition in various suitable amounts, such as from about 60 to about 90 weight percent, in embodiments from about 50 to about 65 weight percent, of the toner or of the solids.

In embodiments, the toner composition may include at least one crystalline resin. As used herein, "crystalline" refers to a polyester with a three dimensional order. "Semicrystalline resins" as used herein refers to resins with a crystalline percentage of, for example, from about 10 to about 90%, in embodiments from about 12 to about 70%. Further, as used hereinafter "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefin polyethylene, polybutylene, polyisobutyrate, ethylenepropylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 50 percent by weight of the toner components, in embodiments from about 10 to about 35 percent by weight of the toner components.

The crystalline polyester resins, which are available from a number of sources, may possess various melting points of, for example, from about 30° C. to about 120° C., in embodiments from about 50° C. to about 90° C. The crystalline resins may have, for example, a number average molecular weight ($M_n$), as measured by gel permeation chromatography (GPC) of, for example, from about 1,000 to about 50,000, in embodiments from about 2,000 to about 25,000, in embodiments from about 3,000 to about 15,000, and in embodiments from about 6,000 to about 12,000. The weight average molecular weight ($M_W$) of the resin is 50,000 or less, for example, from about 2,000 to about 50,000, in embodiments from about 3,000 to about 40,000, in embodiments from about 10,000 to about 30,000 and in embodiments from about 21,000 to about 24,000, as determined by GPC using polystyrene standards. The molecular weight distribution ($M_w/M_n$) of the crystalline resin is, for example, from about 2 to about 6, in embodiments from about 3 to about 4. The crystalline polyester resins may have an acid value of about 2 to about 20 mg KOH/g, in embodiments from about 5 to about 15 mg KOH/g, and in embodiments from about 8 to about 13 mg KOH/g. The acid value (or neutralization number) is the mass of potassium hydroxide (KOH) in milligrams that is required to neutralize one gram of the crystalline polyester resin.

Suitable crystalline polyester resins include those disclosed in U.S. Pat. No. 7,329,476 and U.S. Patent Application Pub. Nos. 2006/0216626, 2008/0107990, 2008/0236446 and 2009/0047593, each of which is hereby incorporated by reference in their entirety. In embodiments, a suitable crystalline resin may include a resin composed of ethylene glycol or nonanediol and a mixture of dodecanedioic acid and fumaric acid co-monomers with the following formula (II):

(II)

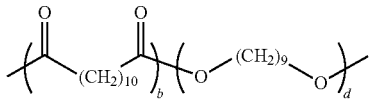

wherein b is from about 5 to about 2000 and d is from about 5 to about 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly(decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly(tetramethylene trithiodicarboxylate), poly(trimethylene dodecane dioate), poly(m-xylene), poly(p-xylylene pimelamide), and combinations thereof.

A crystalline polyester resin in a toner particle of the present disclosure may be present in an amount of from about 1 to about 15 percent by weight, in embodiments from about to about 10 percent by weight, and in embodiments from about 6 to about 8 percent by weight, of the toner particles (that is, toner particles exclusive of external additives and water).

As noted above, in embodiments a toner of the present disclosure may also include at least one high molecular weight branched or cross-linked amorphous polyester resin. This high molecular weight resin may include, in embodiments, for example, a branched amorphous resin or amorphous polyester, a cross-linked amorphous resin or amorphous polyester, or mixtures thereof, or a non-cross-linked amorphous polyester resin that has been subjected to cross-linking. In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

In accordance with the present disclosure, it has been surprisingly found that blocking performance may be improved by about 50% while retaining the good performance on toner charging and fusing. In embodiments, such improvements may be realized by forming toner particles having a core including from about 8% by weight to about 15% by weight of a low molecular weight, high Tg, amorphous resin, in embodiments from about 9% by weight to about 12% by weight of a low molecular weight, high Tg, amorphous resin, in embodiments about 10.85% by weight of a low molecular weight, high Tg, resin, in combination with from about 36% by weight to about 43% by weight of a high molecular weight, low Tg, amorphous resin, in embodiments from about 37% by weight to about 41% by weight of a high molecular weight, low Tg, amorphous resin, in embodiments about 38.85% by weight of a high molecular weight, low Tg, resin. Such toner particles may also include a shell including from about from about 25% by weight to about 35% by weight of a low molecular weight, high Tg, amorphous resin, in embodiments from about 26% by weight to about 30% by weight of a low molecular weight, high Tg, amorphous resin, in embodiments about 28% by weight of the low molecular weight, high Tg, resin.

The ratio of crystalline resin to the low molecular weight amorphous resin to high molecular weight amorphous polyester resin can be in the range from about 1:1:98 to about 98:1:1 to about 1:98:1, in embodiments from about 1:5:5 to about 1:9:9, in embodiments from about 1:6:6 to about 1:8:8.

As noted above, in embodiments, the resin may be formed by emulsion aggregation methods. Utilizing such methods, the resin may be present in a resin emulsion, which may then be combined with other components and additives to form a toner of the present disclosure.

Toner

The resins described above, in embodiments a combination of polyester resins, for example a low molecular weight resin, a high molecular weight resin, and a crystalline resin, may be utilized to form toner compositions. Such toner compositions may include optional colorants, waxes, and other additives. Toners may be formed utilizing any method within the purview of those skilled in the art including, but not limited to, emulsion aggregation methods.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

In addition to the polymer binder resin and photoinitiator, the toners of the present disclosure also optionally contain a wax, which can be either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Where utilized, the wax may be combined with the resin in forming toner particles. When included, the wax may be present in an amount of, for example, from about 1 weight percent to about 25 weight percent of the toner particles, in embodiments from about 3 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302, 486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion(s) including a surfactant, to the emulsion, which may be a mixture of two or more emulsions containing the resin(s). The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1 parts per hundred (pph) to about 1 pph, in embodiments from about 0.25 pph to about 0.75 pph, in some embodiments about 0.5 pph. This provides a sufficient amount of agent for aggregation.

The gloss of a toner may be influenced by the amount of retained metal ion, such as $Al^{3+}$, in the particle. The amount of retained metal ion may be further adjusted by the addition of EDTA. In embodiments, the amount of retained crosslinker, for example $Al^{3+}$, in toner particles of the present disclosure may be from about 0.1 pph to about 1 pph, in embodiments from about 0.25 pph to about 0.8 pph, in embodiments about 0.5 pph.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

In embodiments, the aggregate particles may be of a size of less than about 3 microns, in embodiments from about 2 microns to about 3 microns, in embodiments from about 2.5 microns to about 2.9 microns.

Shell Resin

In embodiments, an optional shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be utilized to form a shell over the aggregates to form toner particles having a core-shell configuration. In some embodiments, an amorphous resin having a high glass transition temperature may be utilized to form a shell over the formed aggregates.

The shell resin may be present in an amount of from about 5 percent to about 40 percent by weight of the toner particles, in embodiments from about 24 percent to about 30 percent by weight of the toner particles.

Once the desired final size of the toner particles is achieved, the pH of the mixture may be adjusted with a base to a value of from about 5 to about 10, and in embodiments from about 6 to about 8. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 90° C., in embodiments about 85° C., which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours.

After coalescence, the mixture may be cooled to a lower temperature, such as from about 20° C. to about 40° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner compositions of the present disclosure after washing or drying. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of the toner. Examples of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/g to about −35 μC/g, and a final toner charging after surface additive blending of from −10 μC/g to about −45 μC/g.

Utilizing the methods of the present disclosure, desirable gloss levels may be obtained. Thus, for example, the gloss level of a toner of the present disclosure may have a gloss as measured by Gardner Gloss Units (ggu) of from about 20 ggu to about 100 ggu, in embodiments from about 50 ggu to about 95 ggu, in embodiments from about 60 ggu to about 90 ggu.

In embodiments, toners of the present disclosure may be utilized as ultra low melt (ULM) toners. In embodiments, the dry toner particles, exclusive of external surface additives, may have the following characteristics:

(1) Volume average diameter (also referred to as "volume average particle diameter") of from about 2.5 to about 20 microns, in embodiments from about 2.75 to about 18 microns, in other embodiments from about 3 to about 15 microns.

(2) Number Average Geometric Standard Deviation (GSDn) and/or Volume Average Geometric Standard Deviation (GSDv) of from about 1.18 to about 1.30, in embodiments from about 1.21 to about 1.24.

(3) Circularity of from about 0.9 to about 1 (measured with, for example, a Sysmex FPIA 2100 analyzer), in embodiments form about 0.95 to about 0.985, in other embodiments from about 0.96 to about 0.98.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser member. The fusing member can be of any desired or suitable configuration, such as a drum or roller, a belt or web, a flat surface or platen, or the like. The fusing member can be applied to the image by any desired or suitable method, such as by passing the final recording substrate through a nip formed by the fusing member and a back member, which can be of any desired or effective configuration, such as a drum or roller, a belt or web, a flat surface or platen, or the like. In embodiments, a fuser roll can be used. Fuser roll members are contact fusing devices that are within the purview of those skilled in the art, in which pressure from the roll, optionally with the application of heat, may be used to fuse the toner to the image-receiving medium. Optionally, a layer of a liquid such as a fuser oil can be applied to the fuser member prior to fusing.

In embodiments, the toner image can be fused by cold pressure fusing, i.e., without the application of heat. Fusing can be effected at any desired or effective pressure, in embodiments from about 1000 pounds per square inch (psi) to about 10,000 pounds per square inch, in embodiments from about 1,500 pounds per square inch to about 5,000 pounds per square inch. One advantage with cold pressure fusing is that it requires low power, and unlike hot roll processes, no standby power. Thus, toners of the present disclosure may be utilized in systems that are more environmentally friendly, having lower energy requirements. Moreover, as heat is not applied to the toners, the toners do not become molten and thus do not offset during fusing.

Toners of the present disclosure may have excellent blocking, i.e., the ability of the toner to resist sticking together during shipping and/or storage.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Comparative Example 1

A yellow emulsion aggregation toner was prepared with a nominal amount (about 14% by weight) of a high Tg amorphous resin in the shell. A yellow polyester toner was prepared at a 2 liter bench scale (about 150 grams dry theoretical toner). The core toner slurry included two emulsions (at a ratio of about 50:50). Both emulsions included amorphous resins including alkoxylated Bisphenol A with terephthalic, fumaric, and dodecenylsuccinic acid co-monomers. One had a high Tg of about 64° C. and the other had a low Tg of about 59° C. Added thereto was about 29.8 grams of a crystalline resin of the following formula:

(II)

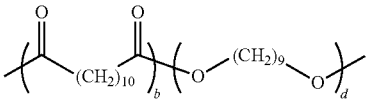

wherein b is from about 5 to about 2000 and d is from about 5 to about 2000, in an emulsion (about 6.8 weight percent), about 1.7 grams of DOWFAX™ 2A1, an alkyldiphenyloxide disulfonate from The Dow Chemical Company, and about 53.2 grams of a yellow pigment, Yellow 74, in a dispersion, and about 46.2 grams of a polyethylene wax (from IGI) in a dispersion. The components were mixed and then pH adjusted to 4.2 using 0.3M nitric acid.

The slurry was then homogenized for about 10 minutes at from about 3000 revolutions per minute (rpm) to about 6000 rpm while adding about 0.5 ppm of aluminum sulfate as a coagulant. The toner slurry was then transferred to the 2 liter Buchi reactor and heated to begin aggregation. The toner slurry aggregated at a temperature of around 45° C. During aggregation, the toner particle size was closely monitored. At around 4.8 micron size, a shell including the same amorphous emulsions (ratio 50:50) as in the core was added to achieve the final targeted particle size of about 5.8 microns. The pH of the slurry was adjusted to about 7.5 using sodium hydroxide (NaOH) and VERSENE-100 from the Dow Chemical Company to freeze, that is stop, the aggregation step.

The process proceeded with the reactor temperature (Tr) increased to achieve 85° C. while maintaining a pH≥about 7.5 until Tr was about 85° C. Once the Tr reached 85° C., the pH of the toner slurry was reduced to 7 with the addition of diluted nitric acid and held until the circularity reached ≥about 0.960.

The final toner particle had a particle size (D50), particle distribution by volume and circularity of 5.74 microns, 1.21 and 0.968, respectively.

Example 1

A yellow toner was prepared as per Comparative Example 1, with double the amount (28%) of high Tg amorphous resin as the shell. The core toner slurry included the two amorphous emulsions described above in Comparative Example 1, including the high Tg amorphous resin and the low Tg amorphous resin, at a ratio of 22:78.

Particles were formed as described above in Comparative Example 1. At around 4.8 micron size, a shell including 100% of the high Tg amorphous emulsion was added to obtain the final targeted particle size of about 5.8 microns. The pH of the slurry was adjusted to about 7.5 using sodium hydroxide (NaOH) and VERSENE-100 from the Dow Chemical Company to freeze, that is stop, the aggregation step.

As in Comparative Example 1, The process proceeded with the reactor temperature (Tr) increased to achieve 85° C. while maintaining a pH≥about 7.5 until Tr was about 85° C. Once the Tr reached 85° C., the pH of the toner slurry was reduced to 7 with the addition of diluted nitric acid and held until the circularity reached ≥about 0.960.

The final toner particle had a particle size (D50), particle distribution by volume and circularity of 6.00 microns, 1.21 and 0.968, respectively.

Blocking

Blocking performance for the toners of Comparative Example 1 and Example 1 were obtained by carrying out a procedure in which two grams of toner with additives was weighed into an open dish and conditioned in an environmental chamber at a specified temperature with about 50% relative humidity. After about 17 hours the samples were removed and acclimated in ambient conditions for about 30 minutes. The amount of blocked toner was quantified by sieving the conditioned samples through a stack of two pre-weighed mesh sieves, which were stacked as follows: 1000 μm on top and 106 μm on bottom. The sieves were vibrated for about 90 seconds at about 1 mm amplitude using a Hosokawa flow tester. After the vibration was completed the sieves were reweighed and toner blocking was calculated from the total amount of toner remaining on both sieves as a percentage of the start weight.

Table 1 below shows the blocking performance of the toner of Comparative Example 1 and Example 1, as well as charging characteristics of the toners in the A-zone and C-zone at 60 minutes (60') and 2 minutes (2').

TABLE 1

Charging Data with Blocking Improved by 50%

| | Comparative Example 1 | Example 1 |
|---|---|---|
| A-zone 60' q/d | 7.5 | 7.9 |
| A-zone 60' q/m | 32 | 36 |
| A-zone 2' q/m | 42 | 46.1 |
| C-zone 60' q/d | 13.4 | 16.7 |
| C-zone 60' q/m | 57 | 72 |
| charge maintenance 24 Hr | 77 | 82 |
| charge maintenance 7 day | 57 | 56 |
| Blocking @ 53° C. | 26 | |
| Blocking @ 54° C. | 89.2 | 44.4 |

In general, toner blocking causes print quality issue like "background" or "streaking" issues and, in severe cases, the blocking can produce clumps of toner that inhibit the development of the toner from the developer housing. For example, at temperatures of about 54° C., toner agglomeration could affect print quality. In a severe case, agglomerated toners would not be able to feed into the printer, or, during running of a machine, into the developer housing. As noted above in Table 1, improved blocking was observed at temperatures up to about 54° C., which meant that the experimental toner had less toner agglomeration during shipping and/or in the printers.

Fusing

The toners of Comparative Example 1 and Example 1 were submitted for fusing evaluation. Fusing performance (gloss, crease, and hot offset measurements) of particles was collected.

All unfused images were generated using a modified DC12 copier from Xerox Corporation. A TMA (Toner Mass per unit Area) of 1.00 mg/cm$^2$ of each toner was made on Color Xpressions+ paper (90 gsm, uncoated) (sometimes referred to as CX+ paper), using a commercially available fusing fixture. Gloss/crease targets were a square image placed in the center of the page.

Process speed of the fuser was set to 220 mm/second (nip dwell of about 34 milliseconds) and the fuser roll temperature was varied from cold offset to hot offset or up to about 210° C. for gloss and crease measurements.

Crease area measurements were carried out with an image analysis system. Print gloss as a function of fuser roll temperature was measured with a BYK Gardner 75° gloss meter. A summary of the fusing results is reported in Table 2 below. Gloss at 185° C., fusing latitude, and the minimum fusing temperature (MFT) is reported.

TABLE 2

| | Comparative Example 1 | Example 1 |
|---|---|---|
| Cold offset on CX+ | 120 | 123 |
| Gloss at 185° C. on CX+ | 66.0 | 68.5 |
| Peak Gloss on CX+ | 69.4 | 68.6 |

TABLE 2-continued

| | Comparative Example 1 | Example 1 |
|---|---|---|
| ΔMFT | −30 | −27 |
| Mottle/Hot Offset CX + 220 mm/second | 185/195 | 200/210 |

As can be seen from Table 2, when the toner of Example 1 was compared to the toner of Comparative Example 1, the gloss data on CX+ paper as measured at 185° C. was very similar and within experimental uncertainty of the measurement. The temperature where hot offset occurred moved to slightly higher fuser roll temperatures. No shift to higher fuser roll temperatures was measured for crease fix MFT. The changes in the particle formulation to improve blocking performance had minimal, if any, detrimental affect on fusing performance.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising, particles comprising:

a core comprising from 8% to 15% by weight of the toner of at least one low molecular weight amorphous resin having a glass transition temperature of from 58.5° C. to 66° C., in combination with from 36% to 43% by weight of the toner of at least one high molecular weight amorphous resin having a glass transition temperature of from 53° C. to 58° C. and a weight average molecular weight greater than 45,000, at least one crystalline resin, an optional wax and an optional colorant; and a shell comprising from 25% to 35% by weight of the toner of at least one amorphous resin having a glass transition temperature of from 58.5° C. to 66° C.

2. The toner according to claim 1, wherein the at least one amorphous resin having a glass transition temperature of from 58.5° C. to 66° C. and the at least one amorphous resin having a glass transition temperature of from 53° C. to 58° C. comprise a polyester resin, and the at least one crystalline resin comprises a polyester resin.

3. The toner according to claim 1, wherein the amorphous resin having, a glass transition temperature of from 58.5° C. to 66° C., the amorphous resin having a glass transition temperature of from 53° C. to 58° C., or both, comprise an amorphous polyester resin of the formula:

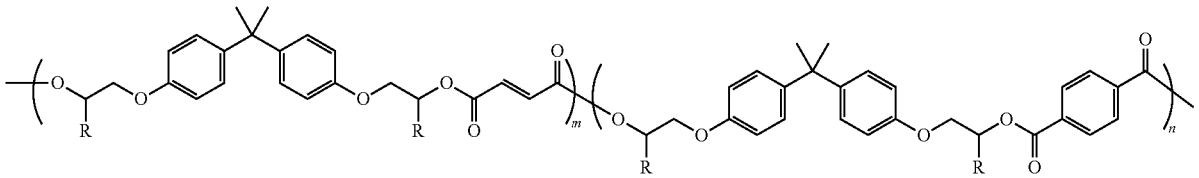

(I)

wherein R is a hydrogen or a methyl group, and m and n represent random units of the copolymer and m is from 2 to 10, and n is from 2 to 10.

4. The toner according to claim 1, wherein the at least one crystalline resin comprises a crystalline polyester resin of the formula:

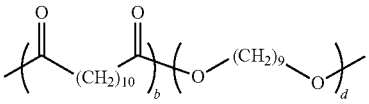

(II)

wherein b is from 5 to 2000 and d is from 5 to 2000.

5. The toner according to claim 1, wherein the core comprises from 9% to 12% by weight of the toner of the at least one amorphous resin having a glass transition temperature of from 58.5° C. to 66° C. and from 37% to 41% by weight of the toner of the at least one amorphous resin having a glass transition temperature of from 53° C. to 58° C.

6. The toner according to claim 1, wherein the shell comprises from 26% to 30% by weight of the toner of the at least one amorphous resin having a glass transition temperature of from 58.5° C. to 66° C.

7. The toner according to claim 1, wherein the wax is selected from the group consisting of polyethylene wax, polypropylene wax, polybutene wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate; diethyleneglycol monostearate, dipropyleneglycol distearate, and combinations thereof.

8. The toner according to claim 1, wherein the wax is present in an amount of from 3 percent to 20 percent by weight of the toner.

9. The toner according to claim 1, wherein particles comprising the toner are from 3 to 15 microns in size.

10. A toner comprising particles comprising:

a core comprising from 8% to 15% by weight of the toner of at least one low molecular weight amorphous resin having a glass transition temperature of from 58.5° C. to 66° C., in combination with from 36% to 43% by weight of the toner of at least one high molecular weight amorphous resin having a glass transition temperature of from 53° C. to 58° C. and a weight average molecular weight greater than 45,000, at least one crystalline resin, at least one wax selected from the group consisting of polyethylene, polypropylene, and polybutene, and combinations thereof, and an optional colorant; and a shell comprising from 25% to 35% by weight of the toner of at least one amorphous resin having a glass transition temperature of from 58.5° C. to 66° C.

11. The toner according to claim 10, wherein the amorphous resin having a glass transition temperature of from 58.5° C. to 66° C., the amorphous resin having a glass transition temperature of from 53° C. to 58° C., or both, comprise an amorphous polyester resin of the formula:

(I)

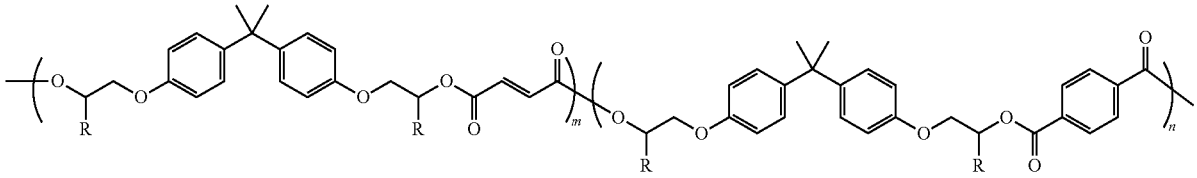

wherein R is a hydrogen or a methyl group, and m and n represent random units of the copolymer and m is from 2 to 10, and n is from 2 to 10.

12. The toner according to claim 10, wherein the at least one crystalline resin comprises a crystalline polyester resin of the formula:

(II)

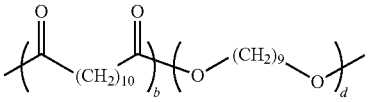

wherein b is from 5 to 2000 and d is from 5 to 2000.

13. The toner according to claim 10, wherein the core comprises from 9% to 12% by weight of the toner of the at least one amorphous resin having a glass transition temperature of from 58.5° C. to 66° C. and from 37% to 41% by weight of the toner of the at least one amorphous resin having a glass transition temperature of from 53° C. to 58° C.

14. The toner according to claim 10, wherein the shell comprises from 26% to 30% by weight of the toner of the at least one amorphous resin having a glass transition temperature of from 58.5° C. to 66° C.

15. The toner according to claim 10, wherein the wax is present in an amount of from 3 percent to 20 percent by weight of the toner.

16. The toner according to claim 10, wherein particles comprising the toner are from 3 to 15 microns in size.

17. A toner comprising:

a core comprising from 8% to 15% by weight of the toner of at least one low molecular weight amorphous polyester resin having a glass transition temperature of from 58.5° C. to 66° C., in combination with from 36% to 43% by weight of the toner of at least one high molecular weight amorphous resin having a glass transition temperature of from 53° C. to 58° C. and a weight average molecular weight greater than 45,000, at least one crystalline polyester resin, at least one wax selected from the group consisting of polyethylene, polypropylene, and polybutene, and combinations thereof, and an optional colorant; and a shell comprising from 25% to 35% by weight of the toner of at least one amorphous polyester resin having a glass transition temperature of from 58.5° C. to 66° C., wherein the amorphous resin having a glass transition temperature of from 58.5° C. to 66° C., the amorphous resin having a glass transition temperature of from 53° C. to 58° C., or both, comprise an amorphous polyester resin of the formula:

(I)

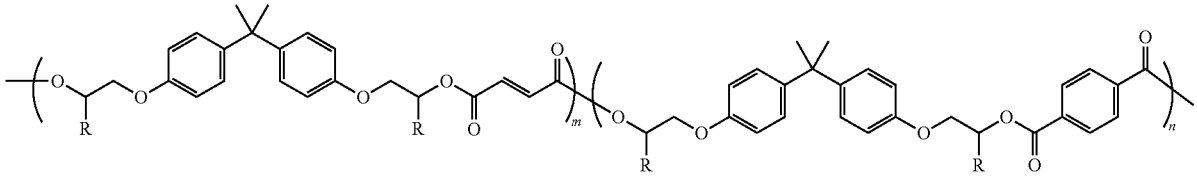

wherein R is a hydrogen or a methyl group, and m and n represent random units of the copolymer and m is from 2 to 10, and n is from 2 to 10, and wherein the at least one crystalline resin comprises a crystalline polyester resin of the formula:

(II)

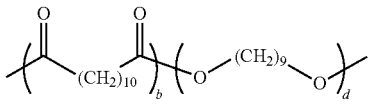

wherein b is from 5 to 2000 and d is from 5 to 2000.

18. The toner according to claim 17, wherein the core comprises from 9% to 12% by weight of the toner of the at least one amorphous resin having a glass transition temperature of from 58.5° C. to 66° C. and from 37% to 41% by weight of the toner of the at least one amorphous resin having a glass transition temperature of from 53° C. to 58° C., and wherein the shell comprises from 26% to 30% by weight of the toner of the at least one amorphous resin having a glass transition temperature of from 58.5° C. to 66° C..

19. The toner according to claim 17, wherein the wax is present in an amount of from 3 percent to 20 percent by weight of the toner.

20. The toner according to claim 17, wherein particles comprising the toner are from 3 to 15 microns in size.

* * * * *